US011401926B2

(12) United States Patent
Huang et al.

(10) Patent No.: US 11,401,926 B2
(45) Date of Patent: Aug. 2, 2022

(54) BUILT-IN AIR PUMP AND INFLATABLE DEVICE

(71) Applicant: BESTWAY INFLATABLES & MATERIAL CORP., Shanghai (CN)

(72) Inventors: Shuiyong Huang, Shanghai (CN); Wanbin Qiu, Shanghai (CN); Ruojin Yin, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 198 days.

(21) Appl. No.: 16/834,443

(22) Filed: Mar. 30, 2020

(65) Prior Publication Data

US 2021/0003126 A1 Jan. 7, 2021

(30) Foreign Application Priority Data

Jan. 31, 2019 (CN) ..... 201920169447.X

(51) Int. Cl.
*F04B 49/06* (2006.01)
*F04B 35/04* (2006.01)

(52) U.S. Cl.
CPC ..... *F04B 49/06* (2013.01); *F04B 35/04* (2013.01); *F04B 2207/043* (2013.01)

(58) Field of Classification Search
CPC ..... F04B 49/06; F04B 35/04; F04B 2207/043
See application file for complete search history.

(56) References Cited

U.S. PATENT DOCUMENTS 9,879,682 B1 * 1/2018 Beliveau ..... A47C 27/082
2006/0065322 A1 * 3/2006 Wu ..... F04D 29/503 141/67
2011/0284108 A1 * 11/2011 Wang ..... F04B 39/0027 137/565.12
2017/0280884 A1 * 10/2017 Liu ..... F04D 25/084
2018/0335042 A1 * 11/2018 Lin ..... F04D 27/008

FOREIGN PATENT DOCUMENTS

WO 2017064553 4/2017

OTHER PUBLICATIONS

Extended European Search Report dated Jan. 29, 2021 (Jan. 29, 2021) issued on related European Patent Application 20166583.3 by the European Patent Office.

* cited by examiner

*Primary Examiner* — Patrick Hamo
(74) *Attorney, Agent, or Firm* — Dickinson Wright PLLC

(57) ABSTRACT

A built-in air pump comprises a housing body and a panel. The panel couples to the housing body and defines an opening. A main pump body couples to the housing body and defines a first accommodating chamber in fluid communication with the opening and with a first and a second venting port. An air replenishing pump has an air replenishing pump body that is located adjacent to the main pump body. The air replenishing pump body couples to the housing body and defines a second accommodating chamber having therein the air replenishing pump. An air passage switch, located in the first accommodating chamber, is moveable between a first and a second position. A controller is in electrical connection with the air replenishing pump and configured to activate the air replenishing pump based on a time determination. An inflatable body including the built-in air pump assembly is also disclosed herein.

19 Claims, 17 Drawing Sheets

BUILT-IN AIR PUMP AND INFLATABLE DEVICE

CROSS REFERENCE TO RELATED APPLICATION

The present application claims priority to Chinese Patent Application Ser. No. CN201920169447.X, filed on Jan. 31, 2019, the entire disclosure of which is hereby incorporated herein by reference.

RELATED FIELD

The present invention relates generally to an air pump system and, in particular, a built-in air pump and an inflatable device.

BACKGROUND

Common inflatable objects on the market, such as inflatable beds, inflatable mattresses, inflatable boats and inflatable toys, are favored by consumers due to their light weight, foldability, portability, and comfortableness. Air pumps are a necessary component to the inflatable objects for inflating or deflating the inflatable object. To make the operation of the air pump easier for the users, the air pump may be located inside the inflatable object.

Existing built-in air pumps include an intelligent air pressure control built-in air pump that inflates and deflates the inflatable object based on a detected air pressure in the inflatable object. Some intelligent air pressure control built-in air pumps include an air replenishing pump that replenishes air in the inflatable object based on the detected air pressure in the inflatable object.

SUMMARY OF THE INVENTION

The present invention improves the built-in air pump of the prior art, and provides a novel built-in air pump and a novel inflatable device, which can replenish air in the inflatable device based on time to a constant pressure inside the inflatable device constant.

It is one aspect of the present invention to provide a built-in air pump for an inflatable body. The built-in air pump comprises a housing body and a panel. The panel couples to the housing body and defines an opening in fluid communication with an outer environment of the inflatable body. A main pump body couples to the housing body and defines a first accommodating chamber, a first venting port, and a second venting port. The first accommodating chamber is in fluid communication with the opening, the first venting port and the second venting port. An air replenishing pump, having an air replenishing pump body, is located adjacent to the main pump body. The air replenishing body couples to the housing body and defines a second accommodating chamber having therein the air replenishing pump. An air passage switch, located in the first accommodating chamber, is moveable between a first position and a second position. When the air passage switch is in the first position, the air passage switch, the main pump body, and the first venting port collectively define an inflation air passage. When the air passage switch is in the second position, the air passage switch, the main pump body, and the second venting port collectively define a deflation air passage. A controller is in electrical connection with the air replenishing pump and is configured to activate the air replenishing pump based on a time determination.

According to an embodiment of the present invention, the built-in air pump can further include at least one connecting member located between the main pump body, the air replenishing pump body and the housing body to connect the main pump body and the air replenishing pump body to the housing body.

According to an embodiment of the present invention, the at least one connecting member can comprise a pair of connecting members, one connecting member of the pair of connecting members being located between the main pump body and the housing body to connect the main pump body to the housing body, and another connecting member of the pair of connecting members being located between the air replenishing pump body and the housing body to connect the air replenishing pump body to the housing body.

According to an embodiment of the present invention, the controller can include a time counter configured to begin counting time in response to a preset condition, and the controller activates the air replenishing pump in response to the time counter counting to a preset time.

According to an embodiment of the present invention, the preset condition can comprise a pressure inside the inflatable body being equal to a preset pressure.

According to an embodiment of the present invention, the time counter can be configured to reset time of the time counter to a preset start time in response to the time counter counting to the preset time.

According to an embodiment of the present invention, the controller can be located in the housing body.

According to an embodiment of the present invention, the main pump body can include a pump body lid plate, the pump body lid plate defining a first upper lid port and a second upper lid port. When the air passage switch is in the first position, the first upper lid port is in fluid communication with the opening and the first venting port to establish the inflation air passage. When the air passage switch is in the second position, the second upper lid port is in fluid communication with the opening and the second venting port to establish the deflation air passage.

According to an embodiment of the present invention, the air passage switch can include a knob, a gear, and a push plate. The knob is located on an exterior surface of the panel and is adjacent to the opening of the panel. The push plate is located in the first accommodating chamber. The push plate is below and coupled to the pump body lid plate. The gear couples to the push plate and the knob through the opening. The push plate is rectilinearly movable in response to a rotational movement of the knob.

According to an embodiment of the present invention, the first venting port and the second venting port can be located opposite of one another whereby the first venting port receives a first valve rod and the second venting port receives a second valve rod.

According to an embodiment of the present invention, the built-in air pump can further include a main pump and a toggle switch. The main pump is located in the first accommodating chamber and below the push plate. The toggle switch is located on the push plate and couples to the main pump for activating and deactivating the main pump.

According to an embodiment of the present invention, the housing body can include a first connecting part, the main pump body can include a second connecting part, and the at least one connecting member connects to the first connecting part and the second connecting part.

According to an embodiment of the present invention, the first connecting part can be located at an outer periphery of the opening, and the second connecting part can be located at an outer periphery of the main pump body.

According to an embodiment of the present invention, the at least one connecting member can have a generally ring-shape and can be coupled to the first connecting part and the second connecting part via a snap-fit engagement.

According to an embodiment of the present invention, the built-in air pump can further include a pair of sealing rings. One sealing ring of the pair of sealing rings is located between the at least one connecting member and the first connecting part. The other sealing ring of the pair of sealing rings is located between the at least one connecting member and at the second connecting part.

According to an embodiment of the present invention, the air replenishing pump can include a core defining an inlet port, an outlet port, and a core opening. At least one pivot arm includes a magnet and a cup. The magnet and the cup couple to the at least one pivot arm. The cup couples to the core and covering the core opening to define an air chamber. An electromagnetic device is configured to generate magnetic flux causing the magnet and the at least one pivot arm to move, thereby causing the cup to compress and expand the air chamber.

According to an embodiment of the present invention, in response to the cup expanding the air chamber, the air replenishing pump can draw air into the air chamber through a first one-way valve located at the inlet port. And, in response to the cup compressing the air chamber, the air replenishing pump can discharge air from the air chamber through a second one-way valve located at the outlet port.

According to an embodiment of the present invention, the at least one pivot arm can comprise a pair of pivot arms located on opposing sides of the core and covering the core opening.

According to an embodiment of the present invention, the air replenishing pump can include a base. The core can be coupled to and the base.

According to an embodiment of the present invention, and the base can define a first groove and a second groove. The first groove is in fluid communication with and the inlet port to establish a first air passage for directing air into and the air chamber via and the inlet port. The second groove is in fluid communication with and the outlet port for directing air to the outer environment.

It is another aspect of the present invention provide an inflatable device. The inflatable device comprises an inflatable body and a built-in air pump located in and the inflatable body. The built-in air pump comprises a housing body and a panel. The panel couples to the housing body and defines an opening in fluid communication with an outer environment of the inflatable body. A main pump body couples to the housing body and defines a first accommodating chamber, a first venting port, and a second venting port. The first accommodating chamber is in fluid communication with the opening, the first venting port and the second venting port. An air replenishing pump, having an air replenishing pump body, is located adjacent to the main pump body. The air replenishing body couples to the housing body and defines a second accommodating chamber having therein the air replenishing pump. An air passage switch, located in the first accommodating chamber, is moveable between a first position and a second position. When the air passage switch is in the first position, the air passage switch, the main pump body, and the first venting port collectively define an inflation air passage. When the air passage switch is in the second position, the air passage switch, the main pump body, and the second venting port collectively define a deflation air passage. A controller is in electrical connection with the air replenishing pump and is configured to activate the air replenishing pump based on a time determination.

According to an embodiment of the present invention, the inflatable body can include a top sheet, a bottom sheet, and an enclosing sheet. The enclosing sheet connect the top sheet with the bottom sheet to define an interior cavity extending between the top sheet, the bottom sheet, and the enclosing sheet.

According to an embodiment of the present invention, the inflatable device can further include a plurality of reinforcing members located in the interior cavity and connected to the top sheet and the bottom sheet.

According to an embodiment of the present invention, the inflatable body can comprises an inflatable bed, an inflatable mattress, an inflatable boat, or an inflatable toy.

According to an embodiment of the present invention, the inflatable device can further include at least one connecting member, located between the main pump body, the air replenishing pump body and the housing body to connect the main pump body and the air replenishing pump body to the housing body.

According to an embodiment of the present invention, the at least one connecting member can comprise a pair of connecting members. One connecting member of the pair of connecting members is located between the main pump body and the housing body to connect the main pump body to the housing body. Another connecting member of the pair of connecting members is located between the air replenishing pump body and the housing body to connect the air replenishing pump body to the housing body.

According to an embodiment of the present invention, the controller can include a time counter configured to begin counting time in response to a preset condition. The controller activates the air replenishing pump in response to the time counter counting to a preset time.

According to an embodiment of the present invention, the air replenishing pump can include a core defining an inlet port, an outlet port, and a core opening. At least one pivot arm includes a magnet and a cup. The magnet and the cup couple to the at least one pivot arm. The cup couples to the core and covering the core opening to define an air chamber. An electromagnetic device is configured to generate magnetic flux causing the magnet and the at least one pivot arm to move thereby causing the cup to compress and expand the air chamber.

According to an embodiment of the present invention, in response to the cup expanding the air chamber, the air replenishing pump can draw air into the air chamber through a first one-way valve located at the inlet port. And, in response to the cup compressing the air chamber, the air replenishing pump can discharge air from the air chamber through a second one-way valve located at the outlet port.

According to an embodiment of the present invention, the at least one pivot arm can comprise a pair of pivot arms located on opposing sides of the core and covering the core opening.

The built-in air pump and the inflatable device constructed in accordance with an embodiment of the present invention can control the start of the air replenishing pump based on time, and are more convenient to use.

BRIEF DESCRIPTION OF THE DRAWINGS

For a more complete understanding of the present invention, reference should now be made to the embodiments illustrated in greater detail in the accompanying drawings and described below by way of examples of the present invention.

DETAILED DESCRIPTION OF THE INVENTION

As will be understood by those having ordinary skill in the art, each feature of any embodiment shown and described with reference to any one of the drawings can be combined with any features shown in one or more other drawings to form other embodiments not explicitly shown or described. The combinations of features shown provide representative embodiments for typical applications. However, various combinations and modifications of the features can be expected in accordance with the teachings of the present disclosure for particular applications or implementations.

Figure 1:
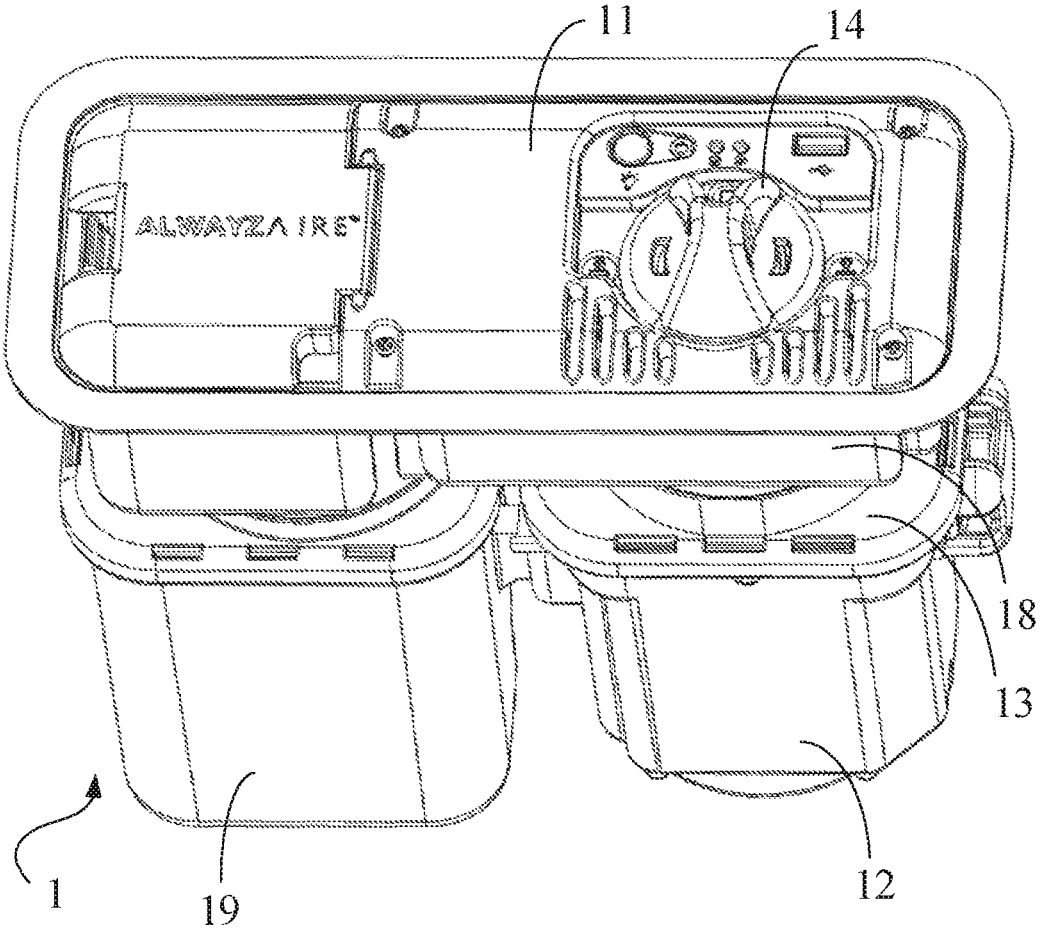
FIG. 1 is a side perspective view of a built-in air pump constructed in accordance with an embodiment of the present invention.
Figure 2:
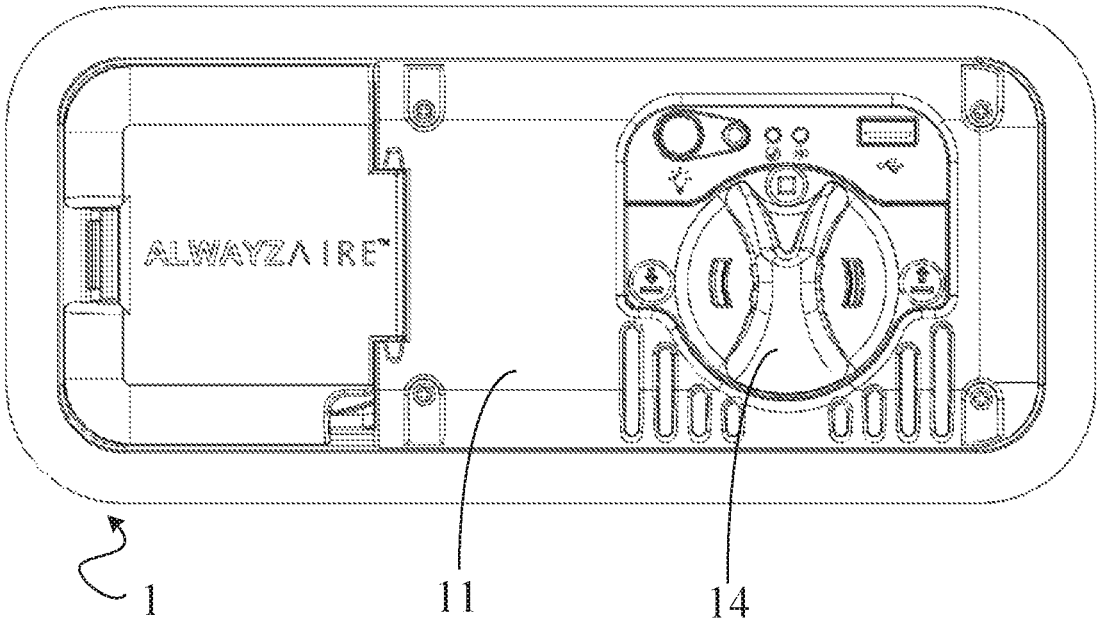
FIG. 2 is a top view of the built-in air pump.
Figure 3:
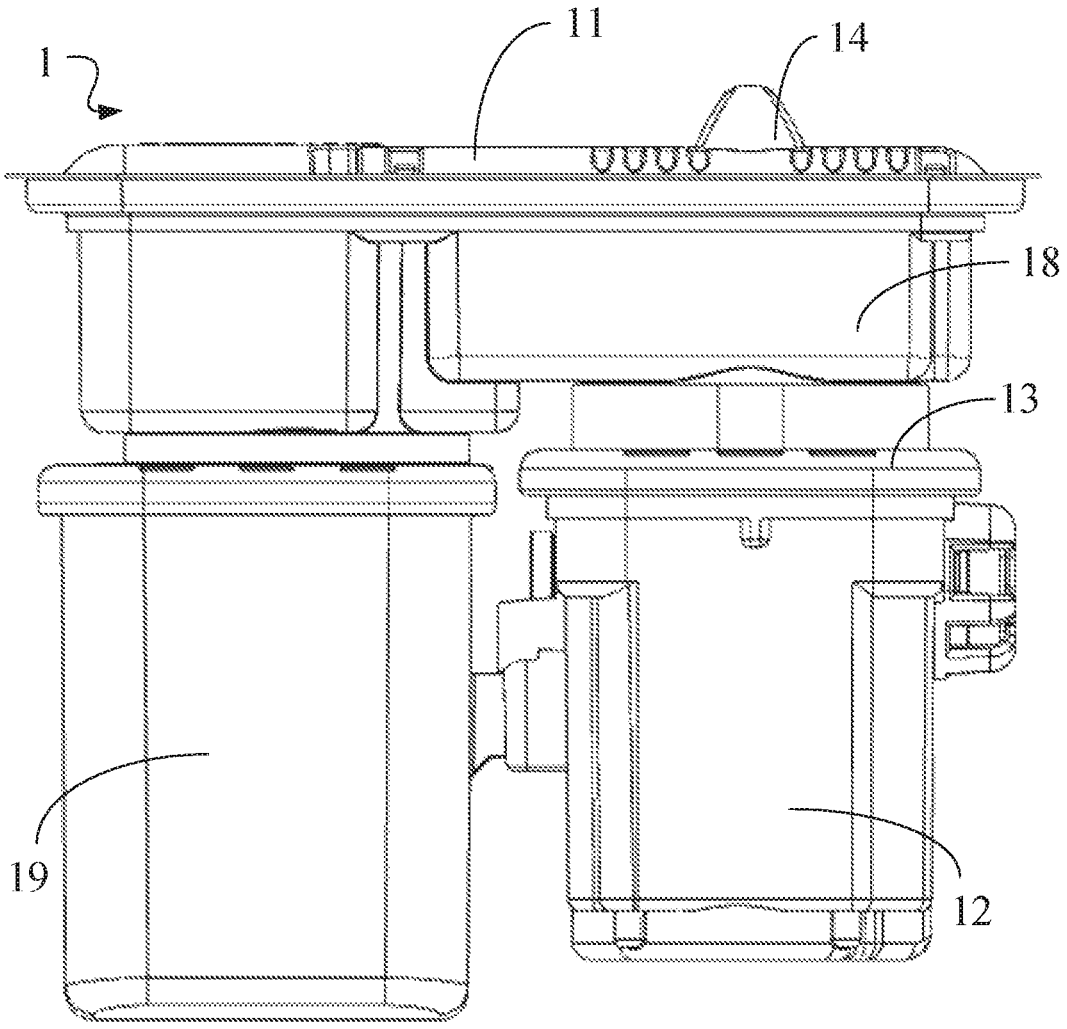
FIG. 3 is a side view of the built-in air pump.
Figure 4:
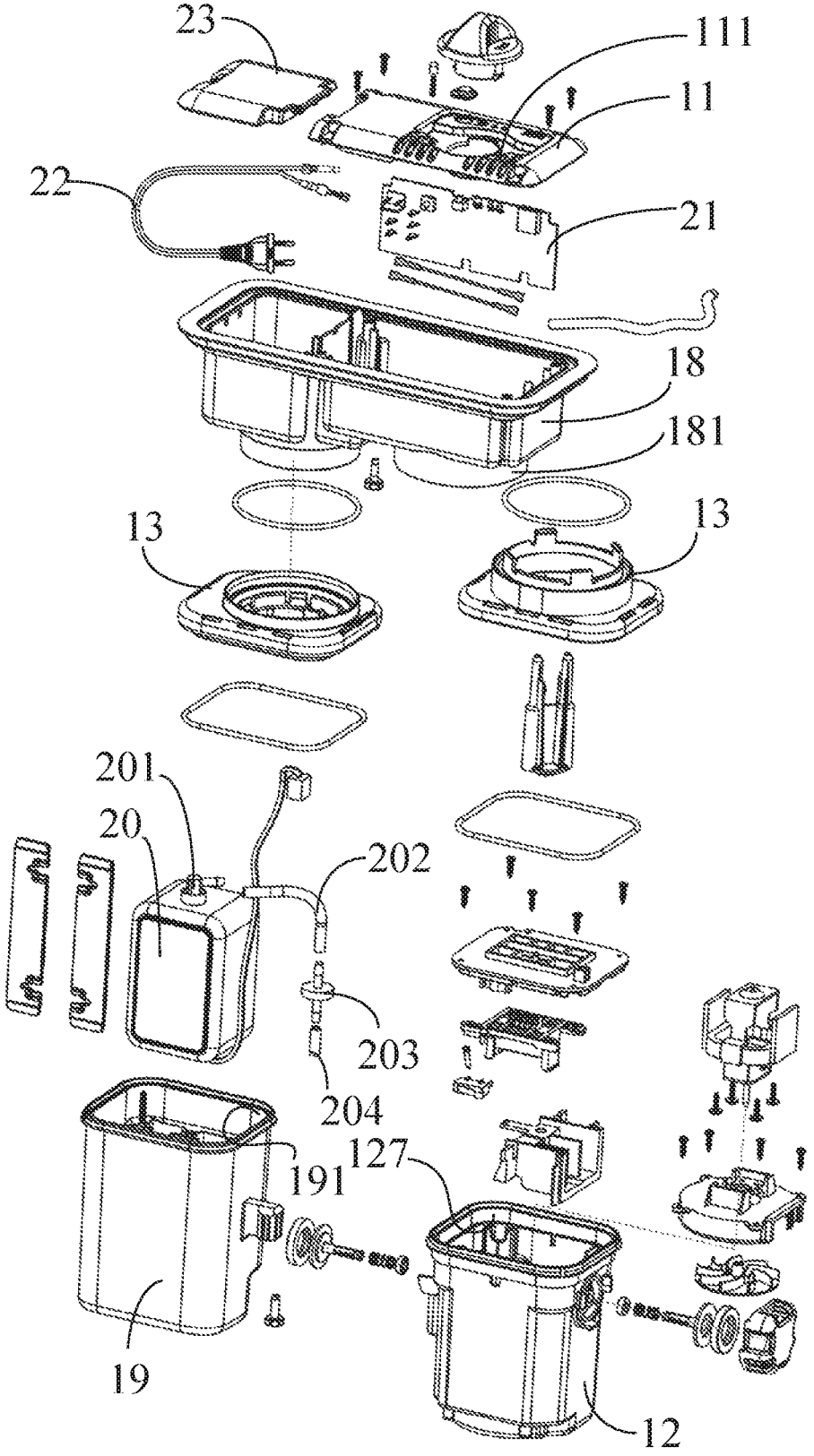
FIG. 4 is an exploded view of the built-in air pump.
Figure 5A:
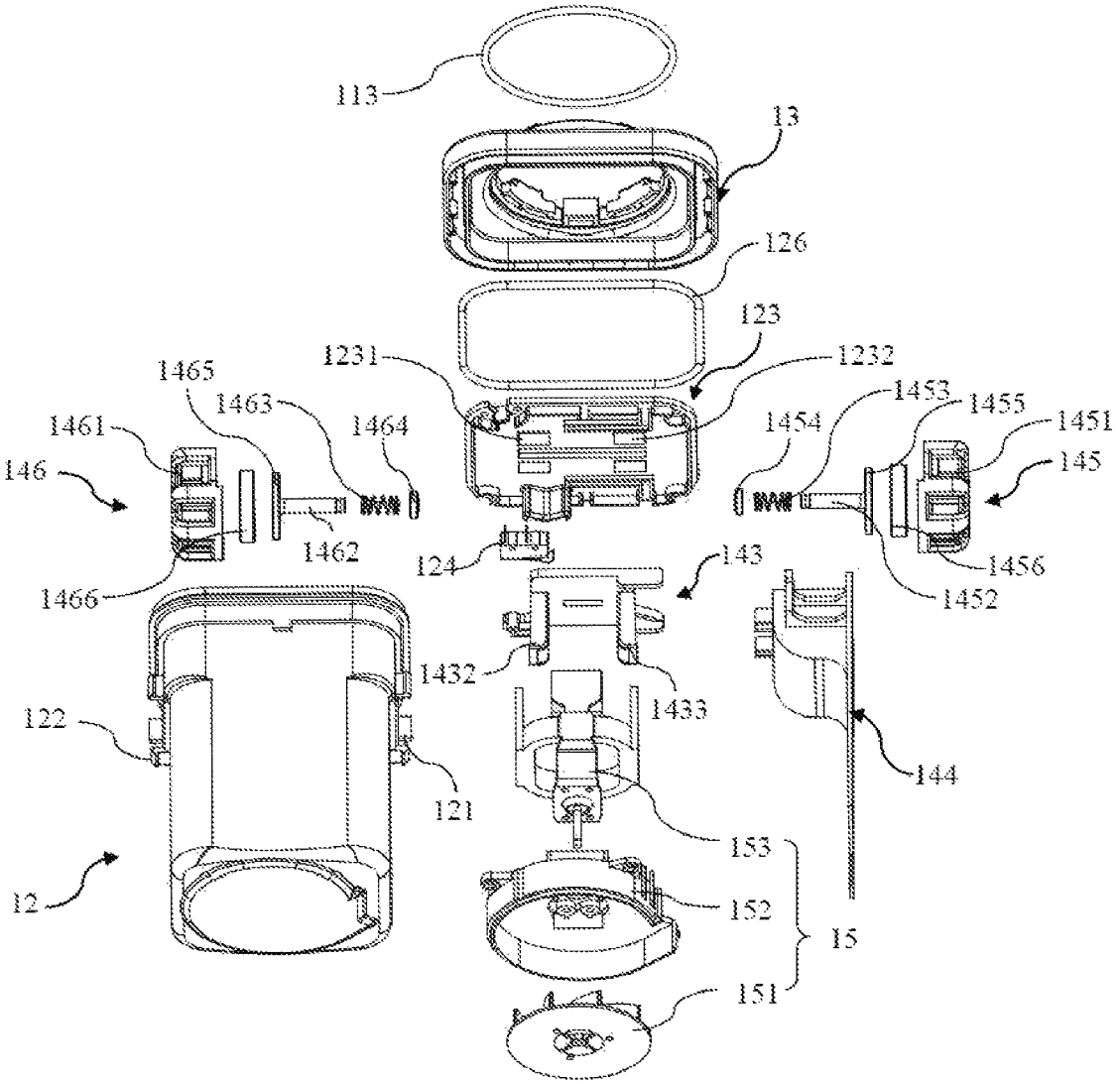
FIG. 5*a* is an exploded view of a main pump assembly of the built-in air pump.
Figure 5B:
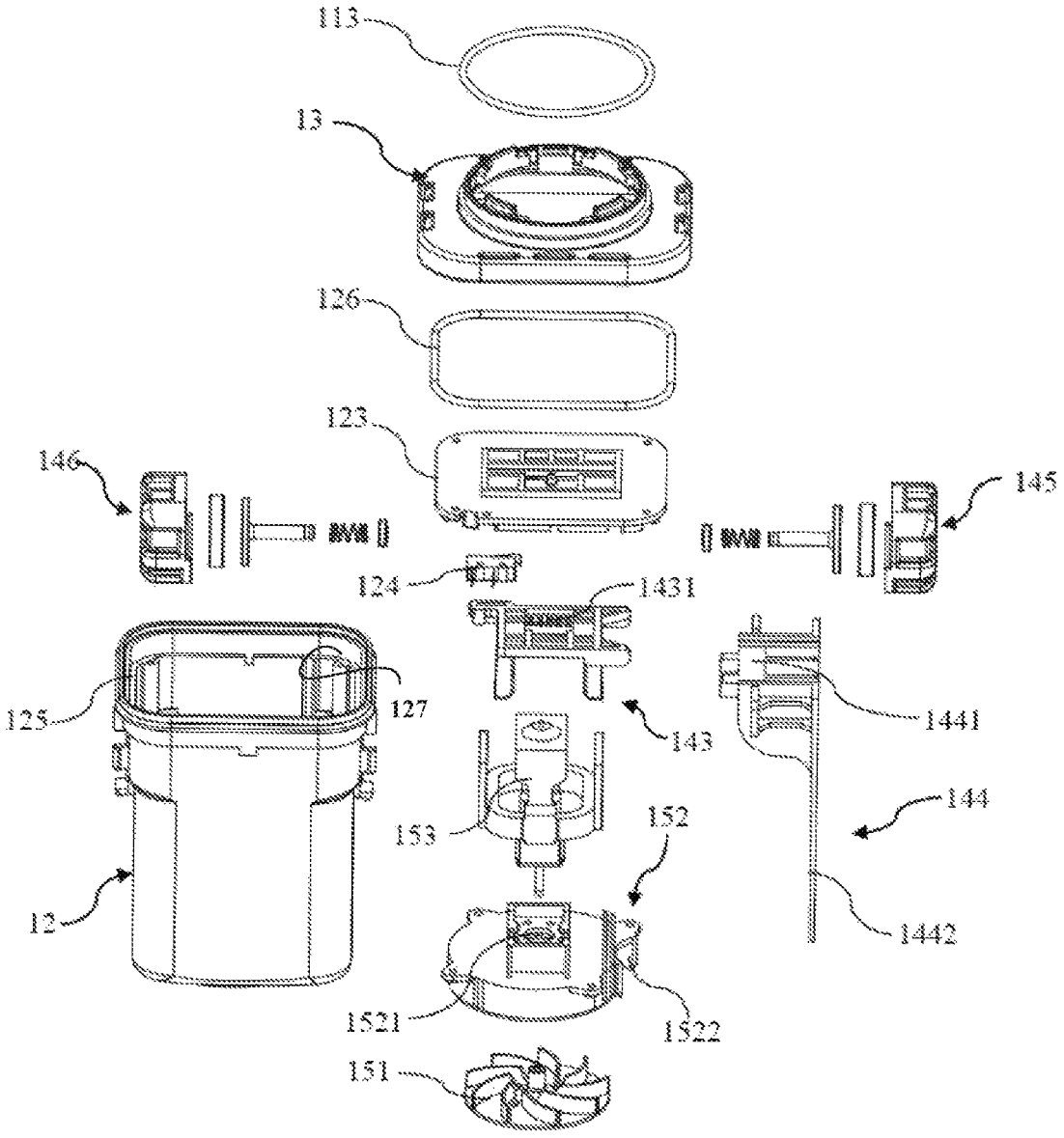
FIG. 5*b* is an exploded side view of a main pump assembly of the built-in air pump.
Figure 6:
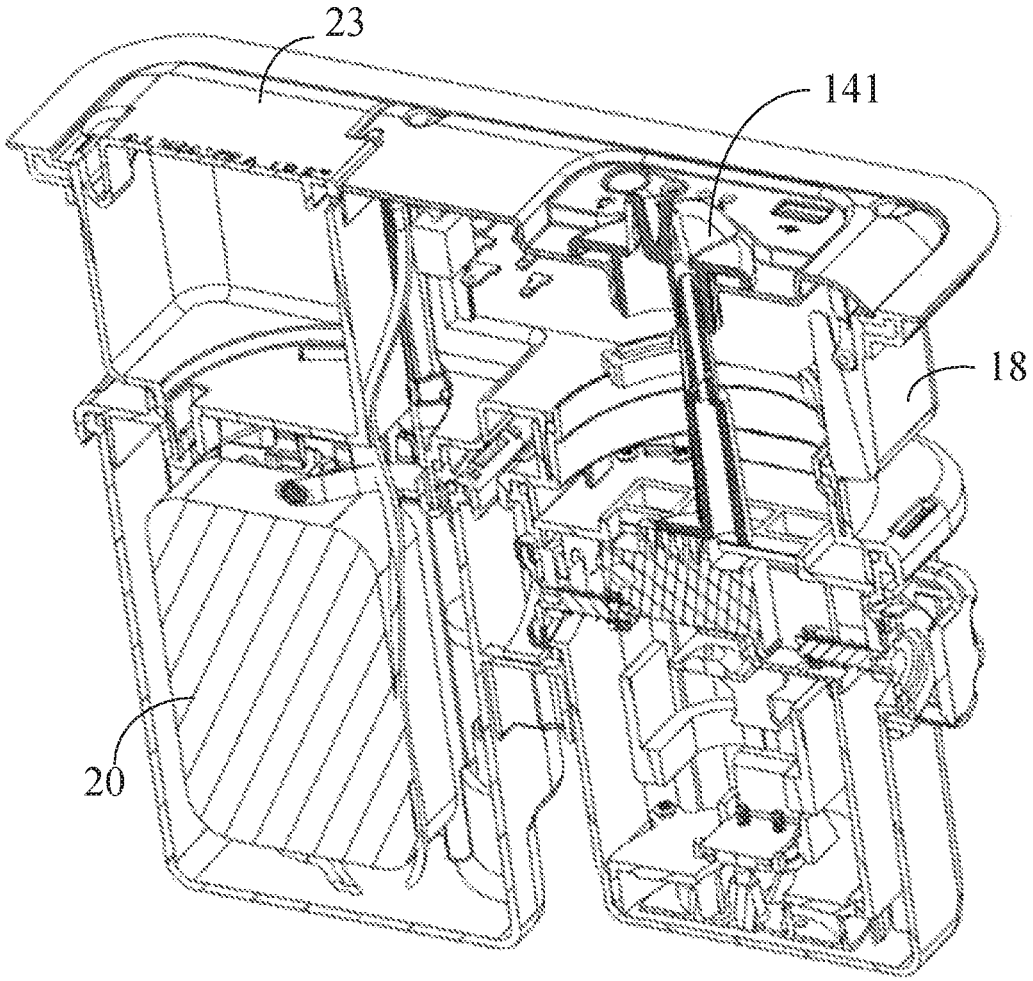
FIG. 6 is a perspective cross-sectional view of the built-in air pump.

FIGS. 1 to 3 are, respectively, a side schematic perspective view, a top view and side view of a built-in air pump 1 for an inflatable body constructed in accordance with an embodiment of the present invention. FIG. 4 is an exploded view of the built-in air pump 1. FIGS. 5*a* and 5*b*, respectively, illustrate exploded views of a main pump assembly of the built-in air pump 1 from different viewing angles. As shown in FIGS. 1 to 3, the built-in air pump 1 constructed in accordance with an embodiment of the present invention comprises a panel 11, a housing body 18, a main pump body 12, an air replenishing pump body 19, at least one connecting member 13 and an air passage switch 14. Details of the built-in air pump 1 will be discussed below.

As shown in FIGS. 4, 5*a* and 5*b*, the panel 11 defines an opening 111 in fluid communication with an outer environment of the inflatable body. The main pump body 12 defines a first accommodating chamber 127, a first venting port 121 and a second venting port 122. The first accommodating chamber 127 is in fluid communication with the opening 111, the first venting port 121 and the second venting port 122. The air replenishing pump body 19 is located adjacent to the main pump body 12 and coupled to the housing body 18. The air replenishing pump body 19 defines a second accommodating chamber 191 having therein the air replenishing pump 20. The panel 11 couples to the housing body 18 and the housing body 18 is connected to the main pump body 12 and the air replenishing pump body 19 via the at least one connecting members 13. The opening 111 of the panel 11 is in fluid communication with the first accommodating chamber 127 of the main pump body 12 and the second accommodating chamber 192 of the air replenishing pump body 19. According to an embodiment of the present invention, the panel 11 has a generally rectangular plate shape, and the main pump body 12 has a generally square column shape. The first venting port 121 and the second venting port 122 are located opposite of one another on the side wall of the main pump body 12.

As shown in FIG. 4, the housing body 18 defines two chambers. One of these two chambers receives a controller 21 (e.g., a PCB according to an embodiment of the present invention). The other chamber of these two chambers receives a power line 22 and may be used as a wire housing box. The panel 11 may also be provided with a wire housing box lid 23 to close the wire housing box. The controller 21 is configured to control the operation of the built-in air pump 1. The power line 22 connects to an external power source (not shown) to provide power to the built-in air pump 1. It should be understood that, in some embodiments of the present invention, the housing body 18 may not be provided, and the panel 11 may direct connect to the main pump body 12 and the air replenishing pump body 19 via the at least one connecting member 13. In this case, the controller 21 and the power line 22 can be located at different positions. For example, the controller 21 may be mounted on the panel 11.

The housing body 18 includes a first connecting part 181. The first connecting part 181 has a generally ring-shape. It should be appreciated that the first connecting part 181 can have other shapes and can have a threaded surface. The main pump body 12 includes a second connecting part 125, as shown in FIG. 5*b*. The second connecting part 125 is located at an outer periphery or an inner surface of the main pump body 12 wherein the main pump body 12 connects to the at least one connecting member 13 at an upper portion of the main pump body 12. According to an embodiment of the present invention, the second connecting part 125 has a generally ring-shape. It should be appreciated that the second connecting part 125 can be of other shapes and can have a threaded surface. According to an embodiment of the present invention, the at least one connecting member 13 has a generally ring-shape. It should be appreciated that, the at least one connecting member 13 can have other shapes, such as but not limited to a circular ring-shaped-upper portion and a square ring-shaped-lower portion, respectively, connected to the first connecting part 181 and the second connecting part 125. Regardless of the shape or shapes employed, the at least one connecting member 13 can comprise a pair of connecting members 13. For example, one connecting member 13 of the pair of connecting members 13 is located between the main pump body 12 and the housing body 18 to connect the main pump body 12 to the housing body 18. Another connecting member 13 of the pair of connecting members 13 is located between the air replenishing pump body 19 and the housing body 18 to connect the air replenishing pump body 19 to the housing body 18. According to one embodiment of the present invention, the upper portion of the at least one connecting member 13 can be matched with the first connecting part 181 and have a threaded surface matched with the first connecting part 181. The lower portion of the at least one connecting member 13 can be matched with the second connecting part 125 and have a male or female-treated surface matched to fit with a corresponding female or male-treated surface of the second connecting part 125. The at least one connecting member 13 may be, respectively, connected to the housing body 18 and the main pump body 12 by threaded and male/female connection. Alternatively, the at least one connecting member 13 may be fixedly connected to the first connecting part 181 and the second connecting part 125 by being snapped on the outer periphery of the first connecting part 181 and the second connecting part 125. Alternatively, the at least one connecting member 13 may be fixedly connected to the first connecting part 181 and the second connecting part 125 by gluing or any other means. The at least one connecting member 13 defines a hollow channel in fluid communication with the opening 111 and with the first accommodating chamber 127 to allow fluid, e.g. air, to pass therethrough. According to an embodiment of the present invention, the at least one connecting member 13 may be integrally formed or have multiple structures coupled together. Alternatively, the at least one connecting member 13 may include a plurality of connecting members 13 formed by the plurality of connecting members 13 being coupled to one other, whether the connecting members are integrally formed or formed by multiple structures coupled together. To enhance the sealing effect of the at least one connecting member 13, a pair of sealing rings 113, 126 are provided between the at least one connecting member 13 and the first and second connecting parts 181, 125.

The main pump body 12 includes a pump body lid plate 123 having a first upper lid port 1231 and a second upper lid port 1232. The air passage switch 14 is movable between a first position and a second position. When the air passage switch 14 is in the first position, the first upper lid port 1231 is in fluid communication with the opening 111 and the first venting port 121 to establish an inflation air passage. In other words, when the air passage switch 14 is in the first position, the air passage switch 14, the main pump body 12, and the first venting port 121 collectively define the inflation air passage. When the air passage switch 14 is in a second position, the second upper lid port 1232 is in fluid communication with the opening 111 and the second venting port 122 to establish a deflation air passage. In other words, when the air passage switch 14 is in the second position, the air passage switch 14, the main pump body 12, and the second venting port 122 collectively define the deflation air passage. As shown in FIGS. 4, 5*a* and 5*b*, the pump body lid plate 123 is matched with the main pump body 12 in size and coupled at the upper portion of the main pump body 12. The first upper lid port 1231 may be a single opening or a plurality of openings. Accordingly, the second upper lid port 1232 may be a single opening or a plurality of openings.

The built-in air pump 1 includes a main pump 15 located inside the main pump body 12. The main pump 15 is configured to inflate or deflate. The main pump 15 includes an impeller 151, a pump cover 152 and a motor 153. The pump cover 152 houses the impeller 151. The motor 153 is located outside of the pump cover 152 and connected to the impeller 151 by a delivery shaft passing through the pump cover 152. The motor 153 can drive the impeller 151 to rotate to generate a fluid pressure to inflate or deflate the inflatable body. The pump cover 152 may be fixed at the bottom portion of the main pump body 12 and define a first aperture 1521 and a second aperture 1522. The first aperture 1521 is in fluid communication with an interior space of the pump cover 152 and the first accommodating chamber 127. The second aperture 1522 is in fluid communication with the interior space of the pump cover 152 and with the inflation air passage or the deflation air passage. As shown in FIGS. 4, 5*a* and 5*b*, the first aperture 1521 may be located at the center of the upper side of the pump cover 152, i.e. at a position where the motor 153 is connected to the impeller 151. The second aperture 1522 may be located at the side of the pump cover 152 and in communication with the inflation air passage/deflation air passage. Accordingly, air can enter the interior of the pump cover 152 from the first accommodating chamber 127 through the first aperture 1521. After being pressurized by the rotation of the impeller 151, air flows out from the interior of the pump cover 152 through the second aperture 1522 at the side of the pump cover 152, and then enter the inflation air passage.

The structure of the air passage switch 14 and how it facilitates inflation and deflation to the inflatable body according to embodiments of the present invention will now be described in detail with reference to FIGS. 4-9 below.

The air passage switch 14 is located in the first accommodating chamber 127 and is movable between the first position and the second position. When the air passage switch 14 is in the first position, the air passage switch 14, the main pump body 12 and the first venting port 121 collectively define the inflation air passage. When the air passage switch 14 is in the second position, the air passage switch 14, the main pump body 12 and the second venting port 122 collectively define the deflation air passage.

The air passage switch 14 includes a knob 141, a gear 142, a push plate 143, a partition plate 144, and first and second valve rods 145, 146. The knob 141, located on an exterior surface of the panel 11, is adjacent to the opening 111 of the panel 11. The push plate 143, located in the first accommodating chamber 127 and below the pump body lid plate 123, is operatively coupled to the pump body lid plate 123. The gear 142 couples to the push plate 143 through the opening 111 of the panel 11. The push plate 143 is rectilinearly movable in response to a rotational movement of the knob 141. The partition plate 144 couples to the push plate 143 and moves between the first position and the second position to establish the inflation air passage and the deflation air passage, respectively, with the main pump body 12. In alternative embodiments of the present invention, it is also possible to switch the air passage by other structures.

According to an embodiment of the present invention, the knob 141 matches with the opening 111. The knob 141 has a through hole passing therethrough to keep the opening 111 clear. The upper portion of the knob 141 is located outside of the panel 11 and defines a recess that makes it easier for users to grip and rotate the knob 141. To allow the users to grip the knob 141 easier, the upper portion of the knob 141 can include a plurality of rough strips. For example, according to an embodiment of the present invention, the knob 141 may be a rotatable handwheel or any other types of knobs, which is not limited by the presently disclosed embodiments of the invention. The lower portion of the knob 141 passes through the opening 111 of the panel 11, and includes a connecting member coupled to the gear 142.

An upper portion of the gear 142 couples the connecting member of the lower portion of the knob 141 such that the gear 142 rotates in response to a rotational movement of the knob 141. According to an embodiment of the present invention, the lower portion of the gear 142 is a spur gear, and the upper surface of the push plate 143 is provided with a ratchet 1431 matched with the spur gear. The ratchet 1431 may be engaged with the spur gear of the gear 142 through a corresponding slot in the pump body lid plate 123. The rotation of the spur gear can drive the push plate 143 to move by a gear-rack transmission. Alternatively, according to an embodiment of the present invention, the lower portion of the gear 142 may be a bevel gear, a helical gear or the like, as long as it is a structure that can convert the rotational movement into a horizontal movement by gear-rack transmission.

The lower portion of the push plate 143 includes a pair of baffles 1432, 1433 which are operatively connected to the first valve rod 145 and the second valve rod 146, respectively. The rotation of the gear 142 can drive the push plate 143 to move rectilinearly, such that the baffles 1432, 1433 are moved, and therefore, respectively push the first valve rod 145 and the second valve rod 146.

The partition plate 144 is located inside of the main pump body 12 and includes an upper portion 1441 and a lower portion 1442. The upper portion 1441 defines a sliding groove to receive the push plate 143 wherein the push plate 143 is movable within the sliding groove. The lower portion 1442 extends in the longitudinal direction, and may be coupled to a side of the pump cover 152. In other words, the lower portion 1442 may be snapped on the side of the pump cover 152, and may be coupled to the pump cover 152 via a sliding groove or by a snap-fit connection. The lower portion 1442 matches with the inner wall of the main pump body 12 to define an air passage. During inflation, air can be pumped outward through the air passage and the first venting port 121, i.e., the air passage functioning as the inflation air passage. During deflation, air can pass through the air passage, upwardly through the push plate 143 and the pump body lid plate 123, and then be pumped outward from the opening, i.e., the air passage functioning as the deflation air passage.

The first valve rod 145 is located at the first venting port 121 and coupled to the push plate 143, to open or close the first venting port 121 in response to the rectilinear movement of the push plate 143. The second valve rod 146 is located at the second venting port 122 and coupled to the push plate 143, to open or close the second venting port 122 in response to the rectilinear movement of the push plate 143.

According to an embodiment of the present invention, the first valve rod 145 is a one-way valve including a first valve cover 1451, a first valve rod stem 1452, a first spring 1453, and a first valve rod cap 1454. The first valve rod stem 1452 is movable within the first valve cover 1451 to open or close the first venting port 121. In particular, the first valve cover 1451 is located outside of the main pump body 12 and coupled to the main pump body 12. One end of the first valve rod stem 1452 includes a first valve plug 1455 matched with the first venting port 121. The other end of the first valve rod stem 1452 connects to the first valve rod cap 1454. The first spring 1453 is sleeved outside of the first valve rod stem 1452 and located between the first valve plug 1455 and the first valve rod cap 1454. The first valve rod cap 1454 couples to the push plate 143. The movement of the push plate 143 can push the first valve rod cap 1454 to move in an axial direction, driving the first valve rod stem 1452 to move. The movement of the first valve rod stem 1452 can drive the first valve plug 1455 to move within the first valve cover 1451 in the axial direction of the first venting port 121, such that the first valve plug 1455 can block the first venting port 121 to close the first venting port 121 or the first valve plug 1455 can move away from the first venting port 121 to open fluid communication through the first venting port 121. Further, a periphery of the first valve plug 1455 may be covered with a sealing member 1456 to enhance the sealing effects of the first valve plug 1455 against the first venting port 121.

According to an embodiment of the present invention, the second valve rod 146 is a one-way valve including a second valve cover 1461, a second valve rod stem 1462, a second spring 1463, and a second valve rod cap 1464. The second valve rod stem 1462 is movable within the second valve cover 1461 to open or close the second venting port 122. In particular, the second valve cover 1461 is located outside of the main pump body 12 and coupled to the main pump body 12. One end of the second valve rod stem 1462 includes a second valve plug 1465 matched with the second venting port 122. The other end of the second valve rod stem 1462 couples to the second valve rod cap 1464. The second spring 1463 is sleeved outside of the second valve rod stem 1462 and located between the second valve plug 1465 and the second valve rod cap 1464. The second valve rod cap 1464 couples to the push plate 143. The movement of the push plate 143 can push the second valve rod cap 1464 to move in an axial direction, driving the second valve rod stem 1462 to move. The movement of the second valve rod stem 1462 can drive the second valve plug 1465 to move within the second valve cover 1461 in the axial direction of the second venting port 122, such that the second valve plug 1465 can block the second venting port 122 to close the second venting port 122 or the second valve plug 1465 can move away from the second venting port 122 to open fluid communication through the second venting port 122. Further, a periphery of the second valve plug 1465 may be covered with a sealing member 1466 to enhance the sealing performance of the second valve plug 1465 against the second venting port 122.

The built-in air pump 1 includes a toggle switch 124, located on the push plate 143 and coupled to the main pump 15 to turn the main pump 15 on and off, and more specifically, the motor 153 of the main pump 15. The pump body lid plate 123 includes a projection (not shown) coupled to the toggle switch 124. In response to a rotational movement of the knob 141, the gear 142 rotates and then the push plate 143 is moved. The movement of the push plate 143 causes the toggle switch 124 thereon to hit the projection on the pump body lid plate 123, so that the toggle switch 124 can be actuated by the projection to turn on the main pump 15 or reversely actuated by the projection to turn off the main pump 15. In other words, the air passage switch 14, the pump body lid plate 123 and the toggle switch 124 form a linkage mechanism.

Figure 7:
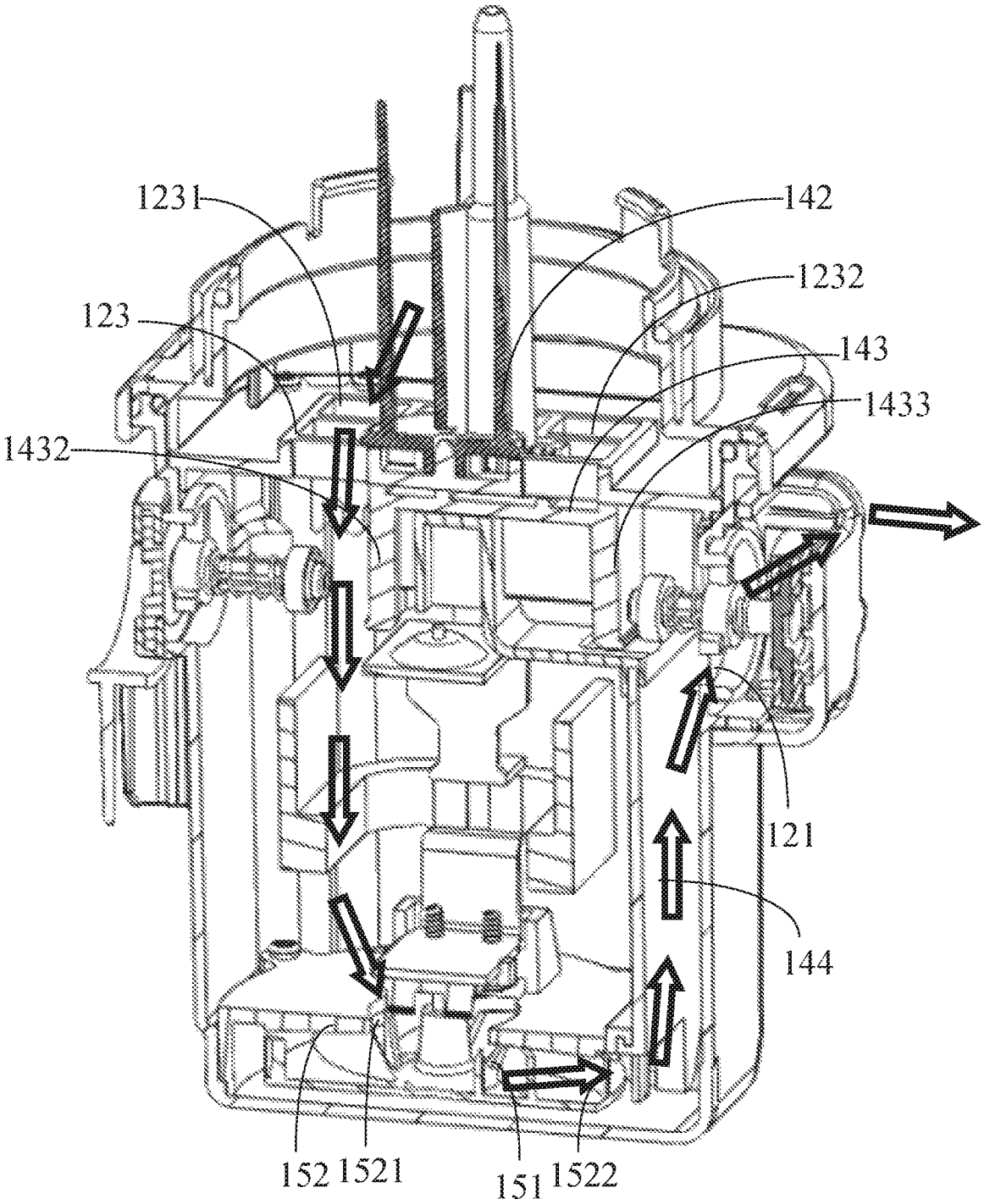
FIG. 7 is a perspective cross-sectional view of the main pump assembly of the built-in air pump when inflation is performed by the main pump assembly.

As shown in FIG. 7, when inflation is performed by the built-in air pump 1, the knob 141 is rotated to the first position (i.e., the inflation position). The rotation of the knob 141 drives the gear 142 connected thereto to rotate. Accordingly, the push plate 143 matched with the gear 142 moves rectilinearly or laterally (for example, to the right), and the toggle switch 124 on the push plate 143 is actuated by the projection on the pump body lid plate 123, such that the main pump 15 activates. The rightward movement of the push plate 143 causes the pair of baffles 1432, 1433 to move to the right, and the baffle 1433 pushes the first valve rod 145 to move to the right, such that the first venting port 121 is opened. At the same time, the rightward movement of the push plate 143 also causes the first upper lid port 1231 of the pump body lid plate 123 to be opened (the second upper lid port 1232 being closed). Thus, the inflation air passage from the opening 111 to the first venting port 121 via the first upper lid port 1231 is established. As indicated by the arrows in FIG. 7, fluid, such as air, enters the first accommodating chamber 127 through the first upper lid port 1231 of the pump body lid plate 123. Then, the fluid enters the interior of the pump cover 152 through the first aperture 1521 of the pump cover 152. After being pressurized by rotation of the impeller 151, the fluid flows out from the interior of the pump cover 152 through the second aperture 1522 at the side of the pump cover 152, entering the air passage delimited by the partition plate 144 and then flowing through the first venting port 121.

Figure 8:
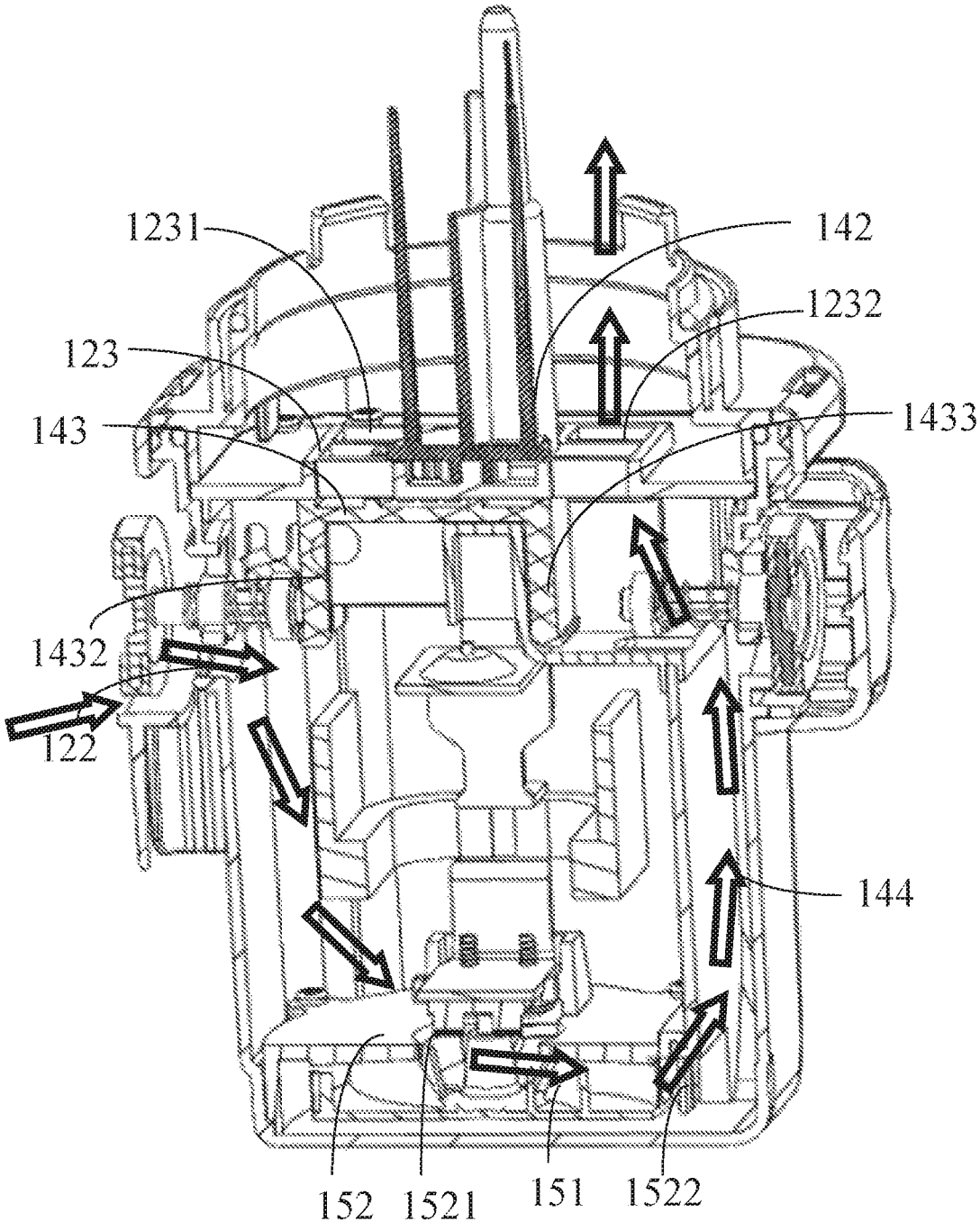
FIG. 8 is a perspective cross-sectional view of the main pump assembly of the built-in air pump when deflation is performed by the main pump assembly.

As shown in FIG. 8, when deflation is performed by the built-in air pump 1, the knob 141 is rotated to the second position (i.e., the deflation position). The rotation of the knob 141 drives the gear 142 connected thereto to rotate. Accordingly, the push plate 143 matched with the gear 142 moves rectilinearly or laterally (for example, to the left), and the toggle switch 124 on the push plate 143 is actuated by the projection on the pump body lid plate 123, such that the main pump 15 activates. The leftward movement of the push plate 143 causes the pair of baffles 1432, 1433 to move to the left, and the baffle 1432 pushes the second valve rod 146 to move to the left, such that the second venting port 122 is opened. At this time, the leftward movement of the push plate 143 also causes the second upper lid port 1232 of the pump body lid plate 123 to be opened (the first upper lid port 1231 being closed). Thus, the deflation air passage from the opening 111 to the second venting port 122 via the second upper lid port 1232 is established. As indicated by the arrows in FIG. 8, fluid, such as air, enters the first accommodating chamber 127 through the second venting port 122 and then enters the interior of the pump cover 152 through the first aperture 1521 of the pump cover 152. After being pressurized by the rotation of the impeller 151, the fluid flows out from the interior of the pump cover 152 through the second aperture 1522 at the side of the pump cover 152 and enters the air passage delimited by the partition plate 144. Then, the fluid passes through the second upper lid port 1232 of the pump body lid plate 123 and through the channel delimited by the at least one connecting member 13, flowing out through the opening 111.

Figure 9:
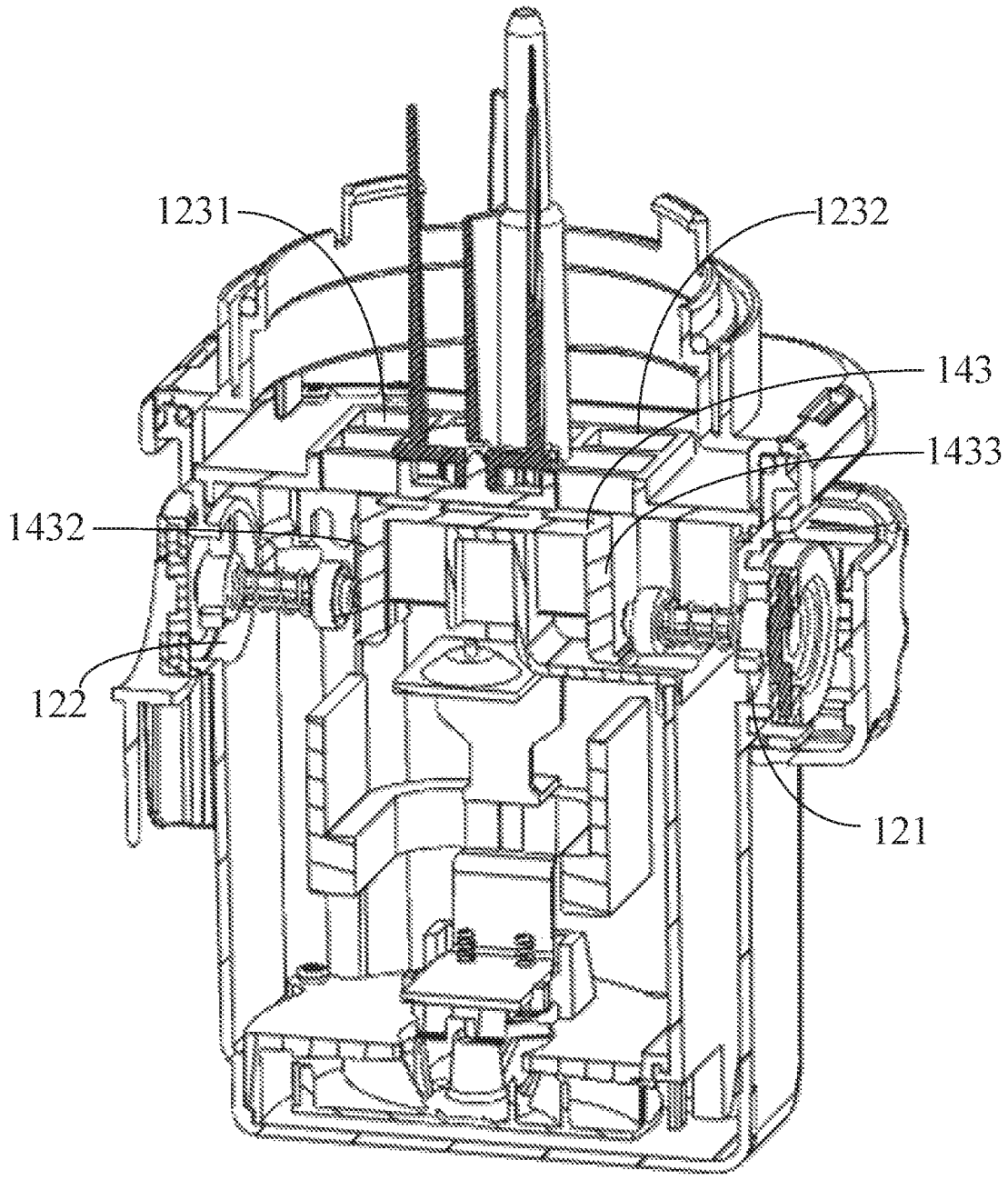
FIG. 9 is a perspective cross-sectional view of the main pump assembly of the built-in air pump when neither inflation nor deflation is performed by the main pump assembly.

To stop the inflation or deflation, the knob 141 is rotated to a position between the first position (i.e., the inflation position) and the second position (i.e., the deflation position). At this time, the push plate 143 is in a middle position, and the toggle switch 124 on the push plate 143 is actuated by the projection on the pump body lid plate 123, causing the main pump 15 to stop working. At the same time, the position of the push plate 143 causes the first upper lid port 1231 and the second upper lid port 1232 of the pump body lid plate 123 to be closed. Because the pair of baffles 1432, 1433 are also in a middle position, the first valve rod 145 and the second valve rod 146 are not pushed. In other words, the positions of the first valve rod 145 and the second valve rod 146 are restored, thereby blocking the first venting port 121 and the second venting port 122 under the action of the springs to close the first venting port 121 and the second venting port 122. At this time, as illustrated in FIG. 9, the air passages are closed by the air passage switch 14, and neither inflation, nor deflation is performed. It should be appreciated that the fluid referenced in the present invention is not limited to air and may be other kinds of gases.

Referring back to FIG. 4, the air replenishing pump 20 can be coupled to the side wall of the air replenishing pump body 19 by a mounting member. The air replenishing pump 20 is configured to replenish air in the inflatable body after the inflatable body is inflated by the main pump 15. According to an embodiment of the present invention, the air replenishing pump 20 is a quiet diaphragm pump. However, the type of the air replenishing pump 20 is not limited thereto, and the air replenishing pump 20 may therefore comprise any other suitable air pump. The air replenishing pump 20 defines an air pump inlet port (not shown) and an air pump outlet port 201. The air pump outlet port 201 is connected to an outlet port connecting pipe 202. The end of the outlet port connecting pipe 202 is connected to a one-way valve 203. The one-way valve 203 is in fluid communication with an air replenishing port (not shown) via a one-way valve connecting pipe 204. The one-way valve 203 only allows fluid to flow into the interior of the inflatable body, and does not allow fluid inside the inflatable body to flow outward. When the air replenishing pump 20 replenishes air in the inflatable body, air from the outer environment of the inflatable body enters the interior of the inflatable body via the opening 111 of the panel, the housing body 18, the air pump inlet port, the air pump outlet port 201, the outlet port connection pipe 202, the one-way valve 203, the one-way valve connecting pipe 204 and the air replenishing port.

FIGS. 11-16*b* show a schematic view of the air replenishing pump 20 constructed according to an embodiment of the present invention. The air replenishing pump 20 includes a core 206, at least one pivot arm 207, a cup 208 and an electromagnetic device 209. According an embodiment of the present invention, the at least one pivot arm includes a pair of pivot arms 207 which are respectively provided on opposite sides of the core 206. Each pivot arm 207 of the pair of pivot arms 207 includes the cup 208 coupled to the pivot arm 207. The core 206 defines an inlet port 2010, an outlet port 2011, a first one-way valve 2012, a second one-way valve 2013, and a core opening 2014. Each pivot arm 207 of the pair of pivot arms 207 includes a magnet 2015 coupled thereto. The cup 208 covers the core opening 2014 of the core 206 to form an air chamber 2016. The electromagnetic device 209 is configured to generate magnetic flux, causing the magnet 2015 and the pivot arm 207 to move, thereby causing the cup 208 to compress and expand the air chamber 2016. When the cup 208 expands the space of the air chamber 2016, the air replenishing pump 20 draws air from the outer environment of the inflatable body into the air chamber 2016 through the first one-way valve 2012 disposed at the inlet port 2010. When the cup 208 compresses the air chamber 2016, the air replenishing pump 20 discharges air in the air chambers 2016 through the second one-way valve 2013 disposed at the outlet port 2011. It should be understood that the air replenishing pump 20 may be provided with only one pivot arm. The first one-way valve 2012 and the second one-way valve 2013 are in the form of one-way valve plates, according an embodiment of the present invention.

According to an embodiment of the present invention, the air replenishing pump 20 includes a base 2017. The core 206 is mounted on the base 2017. The base 2017 includes a first groove 2018, defining a first air passage for directing air from the outer environment of the inflatable body to the inlet port 2010 of the core 206. The base 2017 also includes a second groove 2019, defining a second air passage for directing air in the air chambers 2016 from the outlet port 2011 to the outer environment of the inflatable body. The first groove 2018 and the second groove 2019 are independent of each other. Moreover, the intake and discharge of air are completely staggered in time and do not occur simultaneously.

Figure 16A:
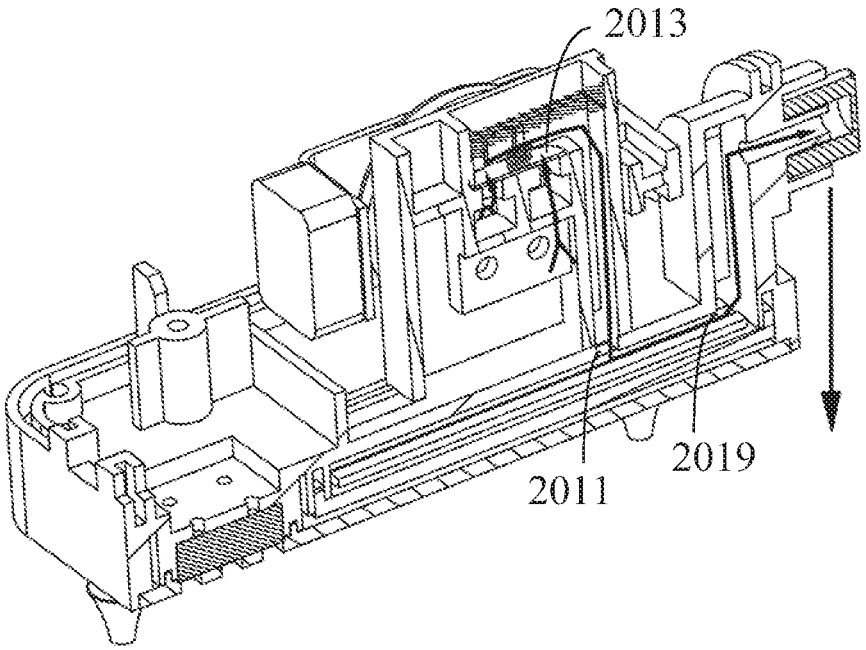
FIG. 16*a* is a cross-sectional perspective view of the air replenishing pump wherein the air replenishing pump is providing air to an inflatable body (not shown)
Figure 16B:
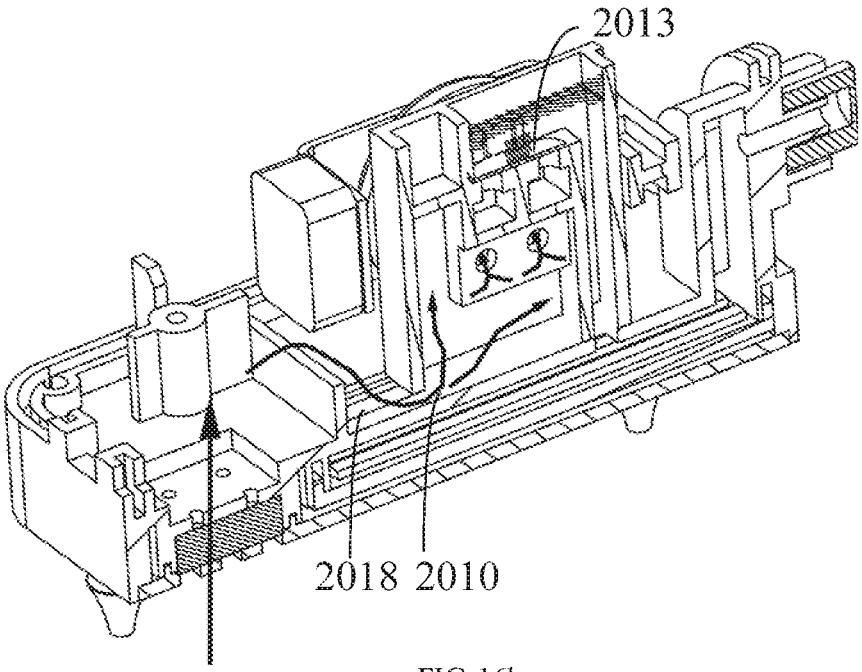
FIG. 16*b* is a cross-sectional perspective view of the air replenishing pump wherein the air replenishing pump is withdrawing air from the inflatable body (not shown) to an outer environment.

According to an embodiment of the present invention, the two cups 208 respectively form two air chambers 2016 with the core 206. Each of the air chambers 2016 includes a first one-way valve 2012 and a second one-way valve 2013. As illustrated in FIG. 16*a* wherein the direction of air flow is indicated by the arrows, when the air chamber 2016 compresses, the first one-way valve 2012 prevents air from entering the first air passage from the air chamber 2016 through the inlet port 2010, and the second one-way valve 2013 allows air to enter the second air passage from the air chamber 2016 through the outlet port 2011 and then be discharged to provide air replenishing to the inflatable body. As illustrated in FIG. 16*b* wherein the direction of air flow is indicated by the arrows, when the space of the air chamber 2016 expands, the second one-way valve 2013 prevents air from entering the air chamber 2016 from the second air passage through the outlet port 2011, and the first one-way valve 2012 allows air to enter the air chamber 2016 from the first air passage through the inlet port 2010, such that the air chamber 2016 can receive air from the first air passage. During this process, air from the outer environment of the inflatable body is provided to the air replenishing pump 20.

One time of compressing and one time of expanding are considered as one operating cycle. The operating frequency depends on the frequency of the alternating current in each country. For example, with an alternating current having a frequency of 50 Hz, the cup 208 compresses and expands the space of the air chamber 50 times per second and the air replenishing pump 20 performs air replenishing operation 50 times per second. With an alternating current having a frequency of 60 Hz, the cup 208 compresses and expands the space of the air chamber 60 times per second and the air replenishing pump 20 performs air replenishing operation 60 times per second.

The controller 21 electrically connects to the air replenishing pump 20 and is configured to activate the air replenishing pump 20 based on a time determination. According to an embodiment of the present invention, the controller 21 includes a time counter. The time counter initiates counting time in response to a preset condition. The controller 21 activates the air replenishing pump 20 in response to the time counter counting to a preset time.

Figure 10:
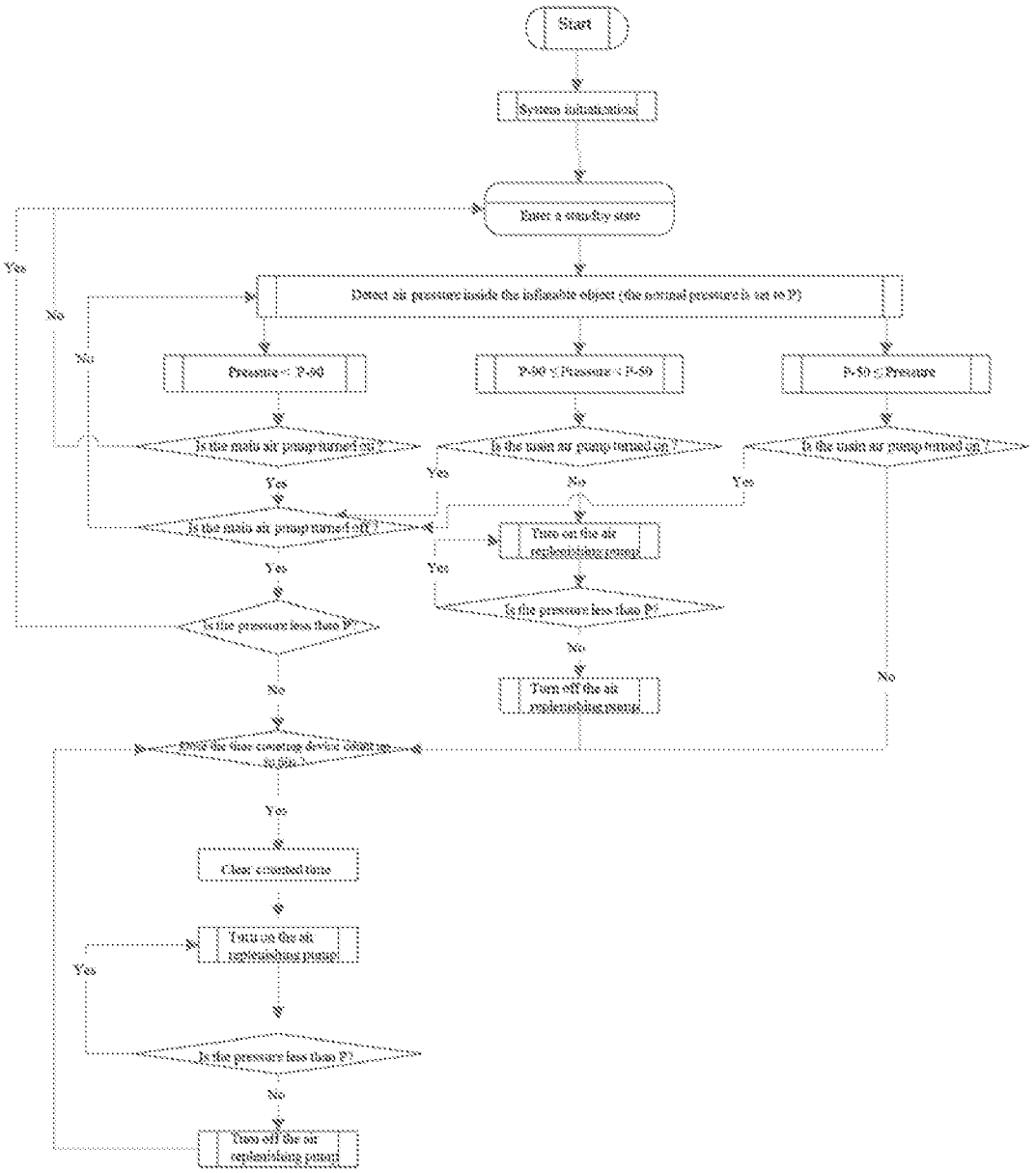
FIG. 10 is a flow chart depicting aspects of a control device for the built-in air pump constructed in accordance with an embodiment of the present invention.
Figure 11:
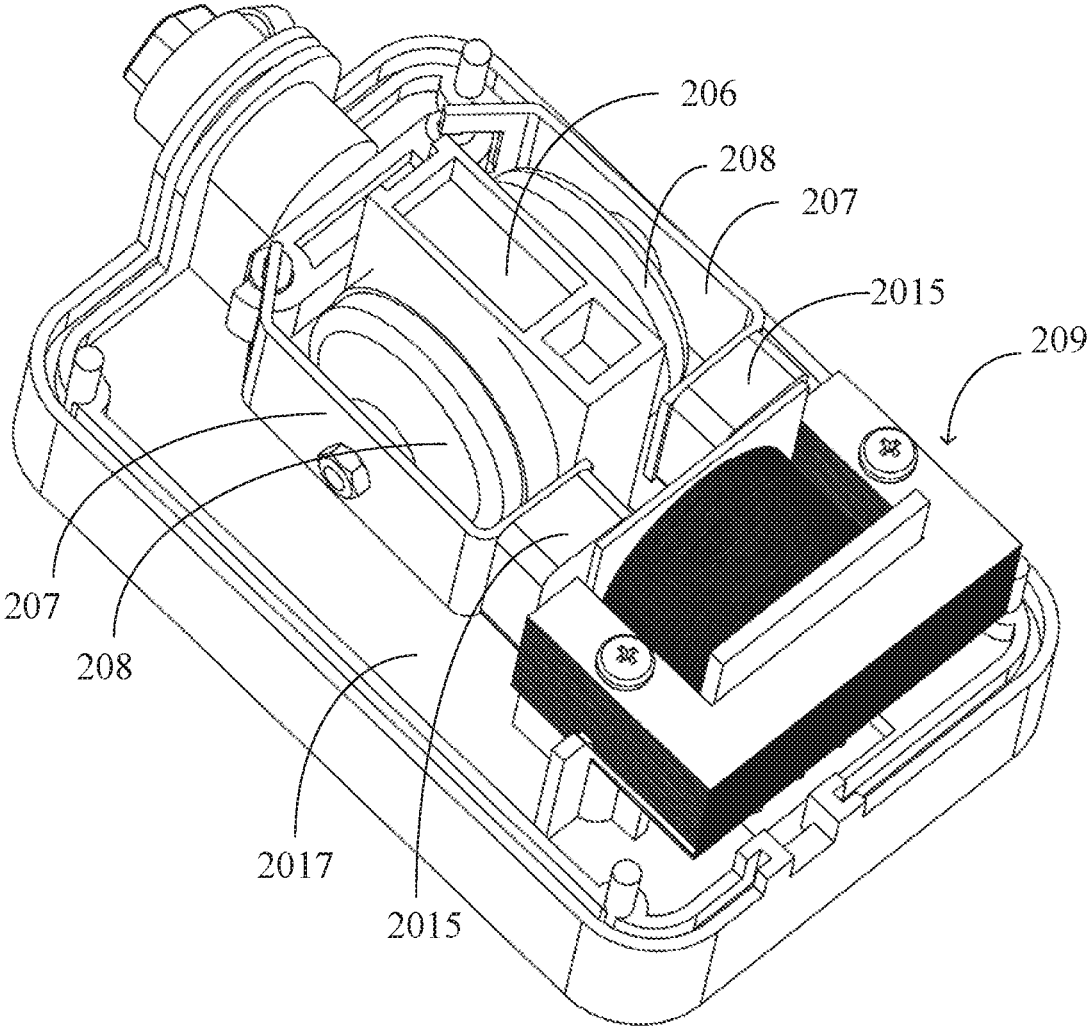
FIG. 11 is a perspective view of an air replenishing pump constructed in accordance with an embodiment of the present invention.
Figure 12:
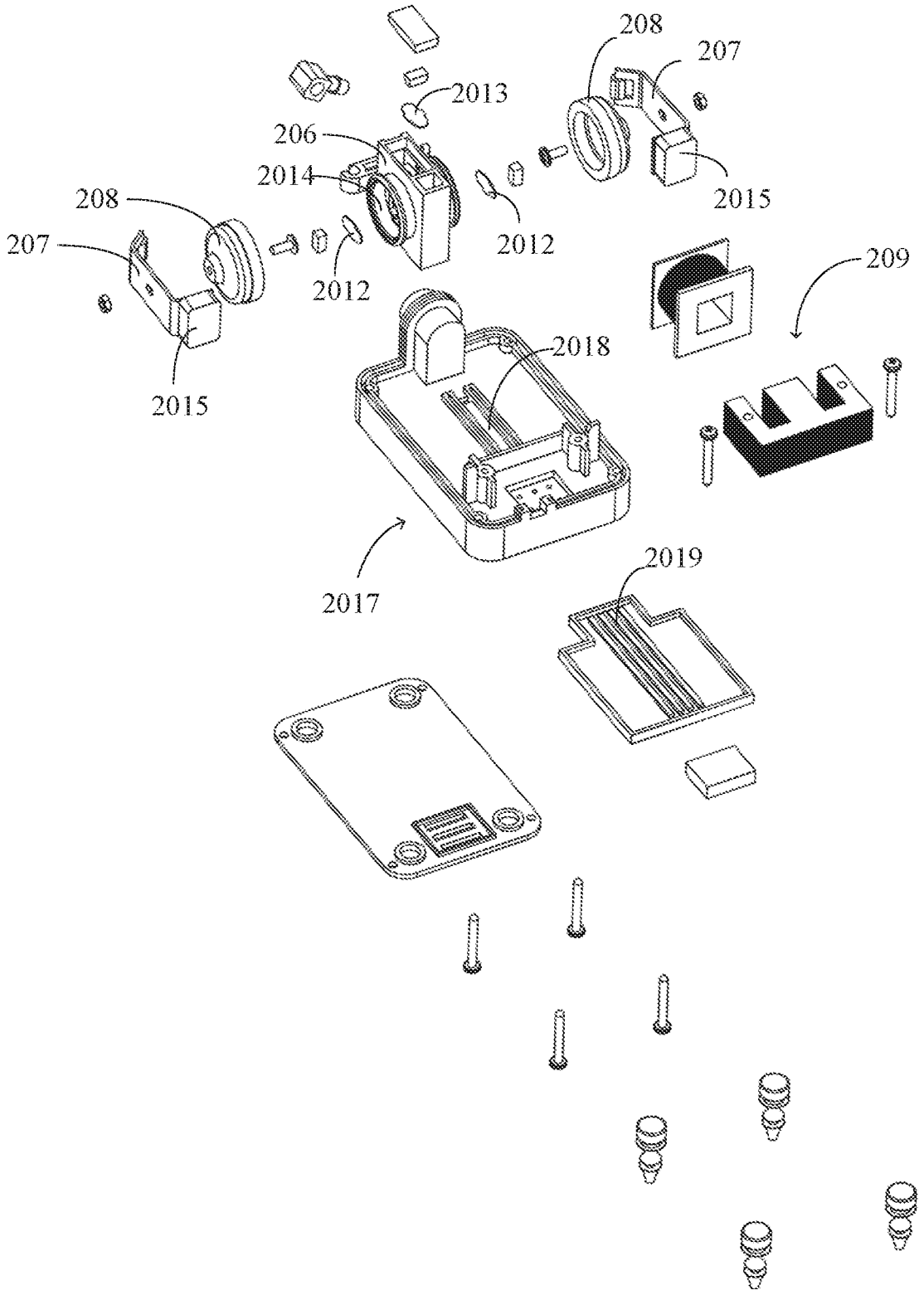
FIG. 12 is an exploded top view of the air replenishing pump.
Figure 13:
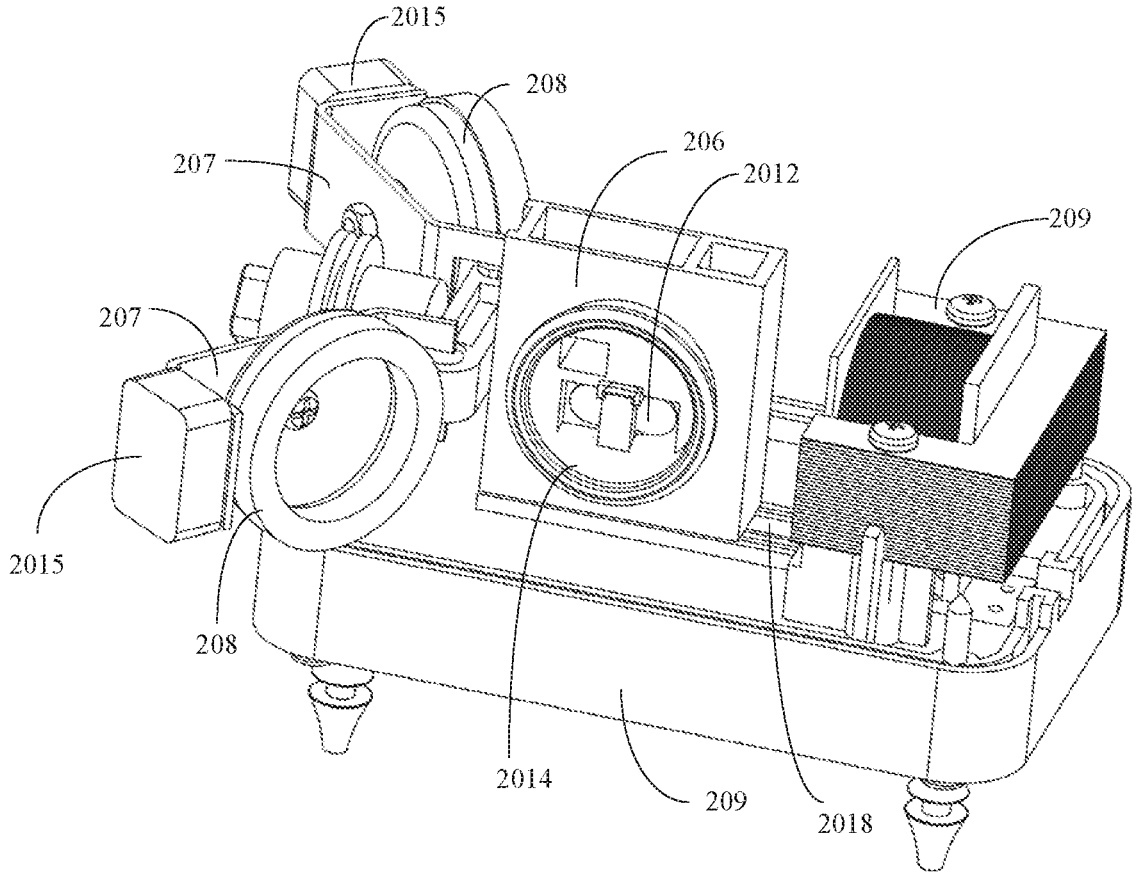
FIG. 13 is a perspective side view of the air replenishing pump.
Figure 14A:
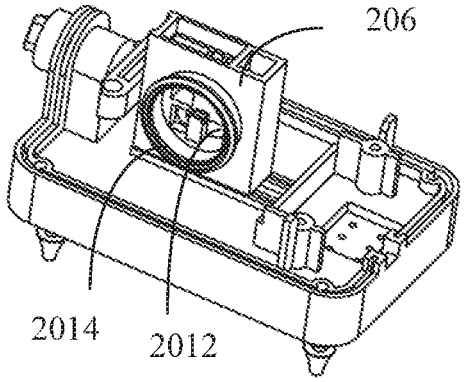
FIG. 14*a* is a perspective side view of the air replenishing pump, without cups.
Figure 14B:
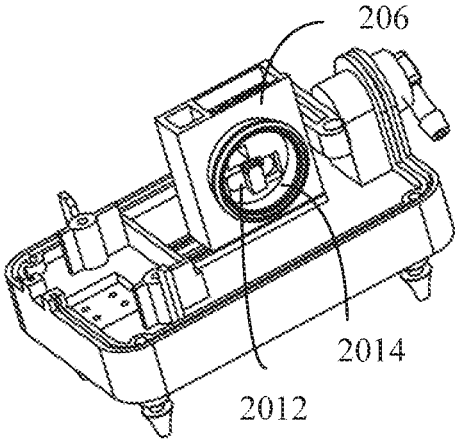
FIG. 14*b* is another perspective side view of the air replenishing pump, without cups.
Figure 14C:
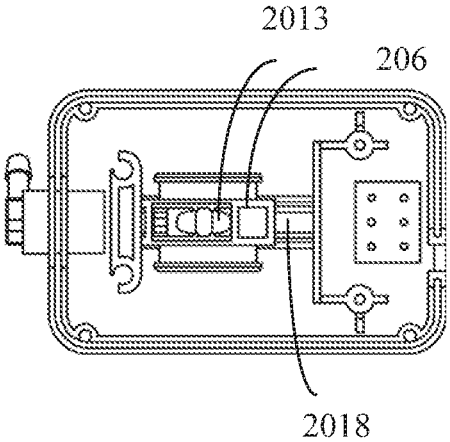
FIG. 14*c* is a top view of the air replenishing pump, without cups.
Figure 15:
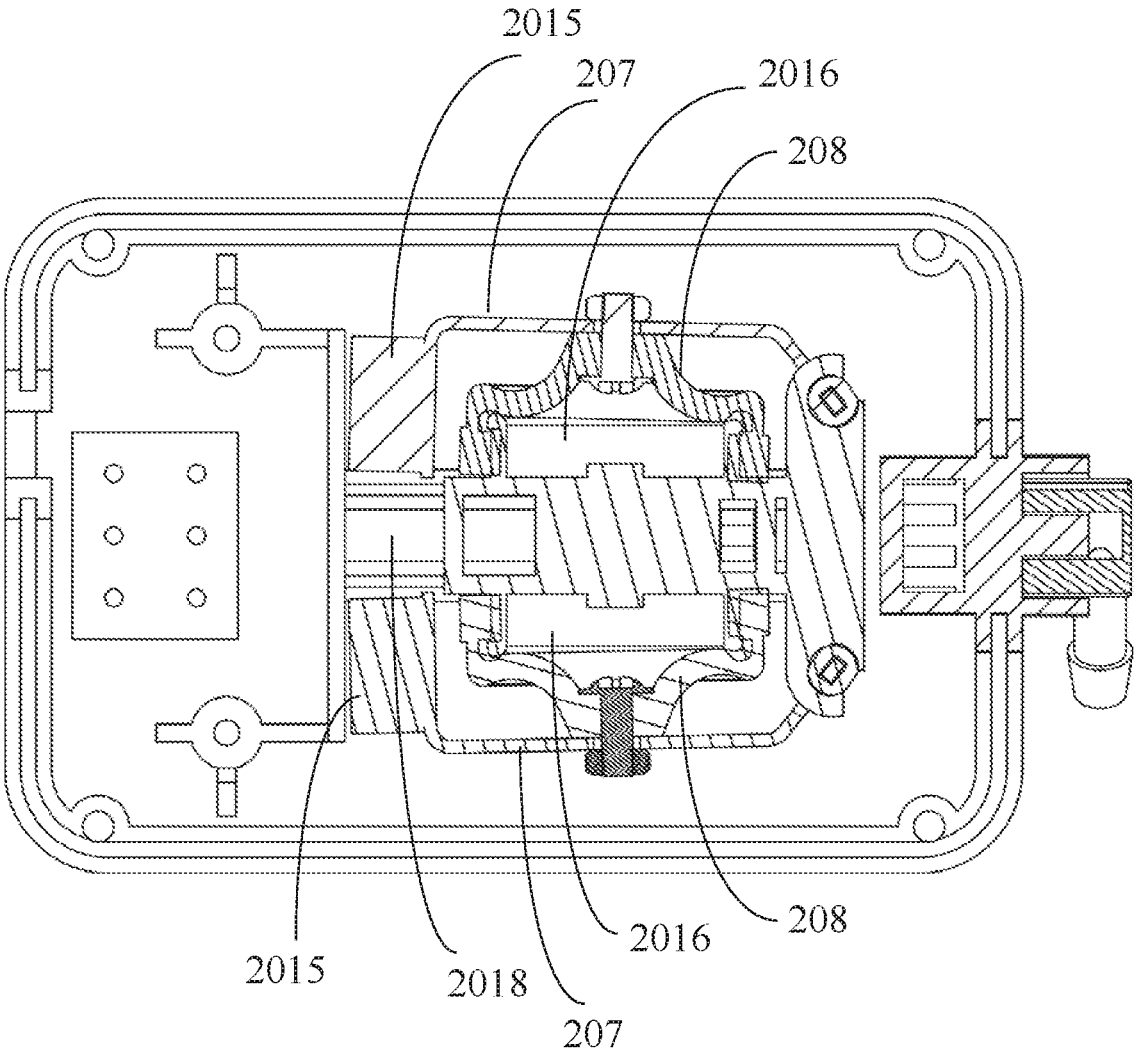
FIG. 15 is a cross-sectional view of the air replenishing pump.

FIG. 10 is a flow chart illustration of the operation of the controller 21 of the built-in air pump 1, according to an embodiment of the present invention. After the controller 21 activates, the controller 21 first performs system initialization and then enters a standby state. At the same time, the controller 21 detects the air pressure inside the inflatable body. And the normal pressure is set to P.

In a first case, the controller 21 first detects whether an air pressure inside the inflatable object is less than P-90. The controller 21 then determines whether the main pump 15 is on. In the event that the main pump 15 is off, the controller 21 returns to a standby state. In the event that the main pump 15 is on, the controller 21 further determines whether the main pump 15 is turned off. In the event that the main pump 15 is off, the controller 21 returns to detecting the air pressure inside the inflatable body. In the event that the main pump 15 is off, the controller 21 determines whether the pressure is less than P. If the pressure is less than P, the controller 21 returns to the standby state. If the pressure is not less than P, it is further determined whether the time counting device has counted to the preset time (for example, 60 seconds).

In a second case, the controller 21 detects the air pressure inside the inflatable object and the air pressure is less than P-50 and greater than or equal to P-90. The controller 21 then determines whether the main pump 15 is on. In a first subcase, in the event that the main pump 15 is on, the controller 21 further determines whether or not the main pump 15 is off. If the main pump 15 is on, the controller 21 returns to detecting the air pressure inside the inflatable body. If the main pump 15 is off, the controller 21 determines whether the pressure is less than P. If the pressure is less than P, the controller 21 returns to the standby state. If the pressure is not less than P, the controller further determines whether the time counting device has counted to the preset time (for example, 60 seconds). In a second subcase, in the event that the main pump 15 is off, and the controller 21 turns on the air replenishing pump 20 Then, the controller 21 determines whether the pressure is less than P. If the pressure is less than P, the air replenishing pump 20 remains in the on state. If the pressure is not less than P, the controller 21 turns off the air replenishing pump 20. Then, the controller 21 further determines whether the time counting device has counted to the preset time (for example, 60 seconds).

In a third case, the controller 21 detects the air pressure inside the inflatable object and the air pressure is greater than or equal to P-50. The controller 21 then determines whether the main pump 15 is on. In a first subcase, in the event that the main pump 15 is on, the controller 21 further determines whether or not the main pump 15 is off. If the main pump 15 is on, the controller 21 returns to detecting the air pressure inside the inflatable body. If the main pump 15 is off, the controller 21 further determines whether the air pressure is less than P. If the air pressure is less than P, the controller 21 returns to the standby state. If the pressure is not less than P, the controller 21 further determines whether the time counting device has counted to the preset time (for example, 60 seconds). In the second subcase, the main pump 15 is not turned on, and it is further determined whether the time counting device has counted to the preset time (for example, 60 seconds).

In particular, the time counting device begins to count time when one of the following preset conditions is satisfied: 1) the pressure inside the inflatable body reaches the preset pressure (P); 2) the air replenishing pump 20 is turned off; or 3) the main pump 15 is off. When the time counting device counts to the preset time, the controller 21 stops the time counting device and clears the counted time. At the same time, the controller 21 activates the air replenishing pump 20 and the air replenishing pump 20 begins to replenish air in the inflatable body. When the pressure inside the inflatable body is less than P, the air replenishing pump 20 is maintained in the on state, and continues replenishing air in the inflatable body. When the pressure inside the inflatable body reaches the preset pressure, the controller 21 deactivates the air replenishing pump 20, thereby causing the time counting device to restart. By controlling the air replenishing pump 20 with the control device 21 to periodically replenish air in the inflatable body, the pressure inside the inflatable object can be kept substantially constant.

One skilled in the art will readily recognize from the disclosure herein, as well as the accompanying drawings and claims that various changes, modifications and variations can be made thereto without departing from the true spirit and fair scope of the present invention, as defined by the following claims.

What is claimed is:

1. A built-in air pump for an inflatable body, comprising, a housing body and a panel, said panel being coupled to said housing body and defining an opening in fluid communication with an outer environment od the inflatable body;

a main pump body coupled to said housing body and defining a first accommodating chamber, a first venting port, and a second venting port, said first accommodating chamber being in fluid communication with said opening, said first venting port and said second venting port;

an air replenishing pump having an air replenishing pump body, said air replenishing pump body located adjacent to said main pump body and coupled to said housing body, said air replenishing pump body defining a second accommodating chamber having therein said air replenishing pump;

an air passage switch located in said first accommodating chamber, said air passage switch being moveable between a first position and a second position;

wherein when said air passage switch is in said first position, said air passage switch, said main pump body, and said first venting port collectively define an inflation air passage;

wherein when said air passage switch is in said second position, said air passage switch, said main pump body, and said second venting port collectively define a deflation air passage; and a controller in electrical connection with said air replenishing pump, said controller configured to activate said air replenishing pump based on a time determination;

wherein said main pump body comprises a pump body lid plate, said pump body lid plate defining a first upper lid port and a second upper lid port;

wherein when said air passage switch is in said first position, said first upper lid port is in fluid communication with said opening and said first venting port to establish said inflation air passage; and wherein when said air passage switch is in said second position, said second upper lid port is in fluid communication with said opening and said second venting port to establish said deflation air passage.

2. The built-in air pump according to claim 1, further including at least one connecting member located between said main pump body, said air replenishing pump body and said housing body to connect said main pump body and said air replenishing pump body to said housing body.

3. The built-in air pump according to claim 2, wherein said at least one connecting member comprises a pair of connecting members, one connecting member of said pair of connecting members being located between said main pump body and said housing body to connect said main pump body to said housing body, and another connecting member of said pair of connecting members being located between said air replenishing pump body and said housing body to connect said air replenishing pump body to said housing body.

4. The built-in air pump according to claim 1, wherein said controller includes a time counter configured to begin counting time in response to a preset condition, and said controller activates said air replenishing pump in response to said time counter counting to a preset time.

5. The built-in air pump according to claim 4, wherein said preset condition comprises a pressure inside the inflatable body being equal to a preset pressure.

6. The built-in air pump according to claim 4, wherein said time counter is configured to reset time of said time counter to a preset start time in response to said time counter counting to said preset time.

7. The built-in air pump according to claim 1, wherein said controller is located in said housing body.

8. The built-in air pump according claim 1, wherein said air passage switch includes a knob, a gear, and a push plate;

wherein said knob is located on an exterior surface of said panel, said knob being adjacent to said opening of said panel;

wherein said push plate is located in said first accommodating chamber, said push plate being below and coupled to said pump body lid plate;

wherein said gear is coupled to said push plate and said knob through said opening; and wherein said push plate is rectilinearly movable in response to a rotational movement of said knob.

9. The built-in air pump according to claim 8, wherein said first venting port and said second venting port are located opposite of one another whereby said first venting port receives a first valve rod and said second venting port receives second valve rod.

10. The built-in air pump according to claim 8, further including a main pump and a toggle switch, said main pump being located in said first accommodating chamber and below said push plate, said toggle switch being located on said push plate and coupled to said main pump for activating and deactivating said main pump.

11. The built-in air pump according to claim 2, wherein said housing body includes a first connecting part, said main pump body includes a second connecting part, and said at least one connecting member is connected to said first connecting part and said second connecting part.

12. The built-in air pump according to claim 11, wherein said first connecting part is located at an outer periphery of said opening, and said second connecting part is located at an outer periphery of said main pump body.

13. The built-in air pump according to claim 11, wherein said at least one connecting member has a generally ring-shape and is coupled to said first connecting part and said second connecting part via a snap-fit engagement.

14. The built-in air pump according to claim 11, further including a pair of sealing rings, one sealing ring of said pair of sealing rings being located between said at least one connecting member and said first connecting part, and the other sealing ring of said pair of sealing rings being located between said at least one connecting member at said second connecting part.

15. The built-in air pump according to claim 1, wherein said air replenishing pump includes:

a core defining an inlet port, an outlet port, and an a core opening;

at least one pivot arm including a magnet and a cup, said magnet and said cup being coupled to said at least one pivot arm, said cup being coupled to said core and covering said core opening to define an air chamber; and an electromagnetic device configured to generate magnetic flux causing said magnet and said at least one pivot arm to move, thereby causing said cup to compress and expand said air chamber.

16. The built-in air pump according to claim 15, wherein, in response to said cup expanding said air chamber, said air replenishing pump draws air into said air chamber through a first one-way valve located at said inlet port; and, in response to said cup compressing said air chamber, said air replenishing pump discharges air from said air chamber through a second one-way valve located at said outlet port.

17. The built-in air pump according to claim 15, wherein said at least one pivot arm comprises a pair of pivot arms located on opposing sides of said core and covering said core opening.

18. The built-in air pump according to claim 15, wherein said air replenishing pump includes a base, said core being coupled to said base.

19. The built-in air pump according to claim 18, wherein said base defines a first groove and a second groove, said first groove being in fluid communication with said inlet port to establish a first air passage for directing air into said air chamber via said inlet port, and said second groove being in fluid communication with said outlet port for directing air to the outer environment.

* * * * *